United States Patent [19]

Peoples

[11] 4,192,501

[45] Mar. 11, 1980

[54] ELECTRIC JUMP ROPE

[76] Inventor: John R. Peoples, Rte. 9, Box 457, Johnson City, Tenn. 37601

[21] Appl. No.: 852,158

[22] Filed: Nov. 16, 1977

[51] Int. Cl.[2] ..... A63B 5/20

[52] U.S. Cl. ..... 272/75; 338/170

[58] Field of Search ..... 272/74, 75, 31 A, 31 B, 272/122, 123, 124, 128, 129, 116, 117, 132, 125; 46/77, 78, 228, 248, 249, 253; 338/127, 137, 155, 170, 118, 170, 160, 162, 167, 189, 190

[56] References Cited

U.S. PATENT DOCUMENTS

| | | | |
|---|---|---|---|
| 949,263 | 2/1910 | Coulter | 338/189 X |
| 1,526,634 | 2/1925 | Gottschalk | 338/170 X |
| 2,911,063 | 11/1959 | Wolfson | 272/75 X |
| 3,061,307 | 10/1962 | Burr | 272/75 |
| 3,064,972 | 11/1962 | Feinn | 272/75 |
| 3,072,402 | 1/1963 | McCombs | 272/74 |
| 3,107,092 | 10/1963 | Morris et al. | 272/75 |
| 4,082,266 | 4/1978 | Elkins | 272/75 |

FOREIGN PATENT DOCUMENTS

| | | | |
|---|---|---|---|
| 632906 | 10/1927 | France | 338/167 |

*Primary Examiner*—Richard C. Pinkham
*Assistant Examiner*—Arnold W. Kramer
*Attorney, Agent, or Firm*—Clarence A. O'Brien; Harvey B. Jacobson

[57] ABSTRACT

An electric jump rope having a longitudinally extending member, the longitudinally spaced ends of which are attached to the end portions of a length of a flexible element. Mounted on the member for rotating the flexible element relative to the member is a motor assembly including a variable speed control arrangement which permits rotation of the flexible member to be varied by a person gripping the longitudinally extending member in order to skip rope with the invention.

2 Claims, 5 Drawing Figures

ELECTRIC JUMP ROPE

BACKGROUND OF THE INVENTION

1. Field of the Invention

This invention relates generally to a jump or skipping rope, and particularly to a jump rope being provided with an electric motor, and the like, for rotating the rope, cord, or other suitable flexible member relative to a person skipping rope with the invention.

2. Description of the Prior Art

It is generally known to provide skipping ropes with power actuation, an example of which can be found in U.S. Pat. No. 3,612,522, issued Oct. 12, 1971, to M. A. Ekonen. In this known device, one end of a skipping rope is attached to a motor-driven output shaft by means of a suitable clutch arrangement, with the motor unit being itself mounted on a suitable stand, and the other end of the skipping rope being secured to a swivel-type fitting mounted on a supporting member. Further, U.S. Pat. No. 3,013,798, issued Dec. 19, 1961, to D. D. Willoughby, discloses a power operated recreational jumping apparatus wherein a horizontal drive shaft is journaled for rotation at the upper end of one of a pair of spaced uprights standards which support a stiff yet resilient arched jumping member between them.

U.S. Pat. No. 3,064,972, issued Nov. 20, 1962, to L. S. Feinn, discloses a rope training device wherein a gear train is mounted on a bar to be held by a person excerising in order to cause a pair of jump ropes to rotate in a predetermined relationship one to the other, while U.S. Pat. No. 3,107,092, issued Oct. 15, 1963, to E. C. Morris, et al., discloses a rope jumping device also having a pair of jumping ropes extending between a pair of handles, with a drive motor disposed in each of the handles for rotating the jumping ropes.

SUMMARY OF THE INVENTION

It is an object of the present invention to provide an electric jump rope which is fun to use and at the same time provides one with excellent and beneficial exercise.

It is another object of the present invention to provide an electric jump rope which can be used in a very small space, and which requires little coordination for the beginner, coordination being improved with use.

It is still another object of the present invention to provide an electric jump rope which may be adjusted by the user to jump either forward or backward, and which may be folded and stored in a small case for storage, travelling, and the like.

Yet another object of the present invention is to provide an electric jump rope which can be adjusted for use by any size individual by lengthening or shortening the flexible element employed with the device.

A still further object of the present invention is to provide a motor-actuated rope-skipping device of simple, yet rugged and reliable construction.

These and other objects are achieved according to the present invention by providing a motor-driven jump rope having: a longitudinal extending member provided with longitudinally spaced ends; a flexible element having end portions attached to the member at respective ones of the longitudinally spaced ends of the member; and a motor assembly mounted on the member and connected to the flexible element for rotating the flexible element relative to the member.

The motor assembly preferably includes an electric motor mounted at one of the ends of the member, batteries for energizing the electric motor disposed at the other of the ends of the member, and a capable electrically connecting the motor to the batteries. Advantageously, the motor is a variable speed motor of conventional construction, with the motor assembly further including a variable speed switch inserted in the cable electrically connecting the batteries to the motor for controlling the speed of the motor. This variable speed switch can comprise a rheostat suitably actuated by one arm of a lever pivotally mounted on the member and having a pair of diverging arms. The other of the arms is engaged by a hand of a person grasping the member for pivoting the lever toward the member and increasing resistance of the rheostat for increasing the speed of the variable speed motor.

A spring is mounted on the member and engages the other of the arms of the lever for drawing the other of the arms away from the member, while a ratchet is advantageously mounted on the member and arranged engaging the other of the arms of the lever for holding the lever in any one of a plurality of positions against the bias of the spring in order to give incremental control to the variable speed motor of the device.

The longitudinally extending member preferably is constructed as a tubular housing having an elongated rod journaled within the housing and extending longitudinally therefrom at the ends of the member, with the flexible element being attached directly to the rod at points without the housing. Branch portions are provided at either longitudinal end of the member and arranged extending perpendicularly to the extent of the tubular housing and rod for enclosing the motor and batteries, respectively, at the longitudinally spaced ends of the member.

The flexible element preferably length adjustable fittings at the end portions thereof for adjustably connecting the flexible element to the rod and permitting the length of the flexible element to be effectively varied by adjustment of the fittings. Greater adjustments of the length of the flexible element can be made by varying the point of attachment of the flexible element to a respective one of the fittings.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
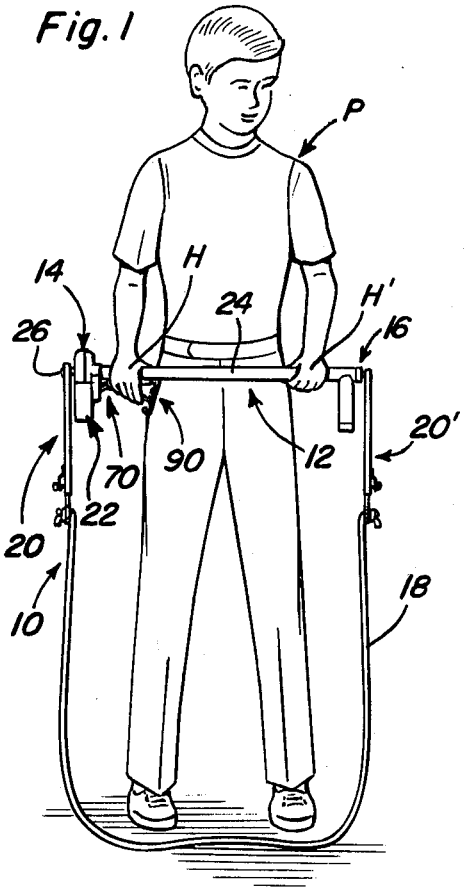
FIG. 1 is a schematic, front elevational view showing the manner in which a motor-driven jumping rope according to the present invention is used by a person.
Figure 3:
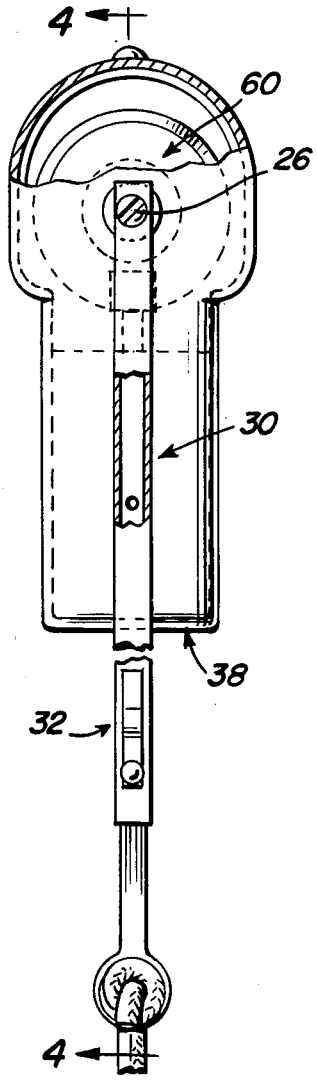
FIG. 3 is an enlarged, fragmentary, end elevational view, partly broken away into section, showing the jump rope according to the present invention as seen from the left hand side in FIGS. 1 and 2.
Figure 5:
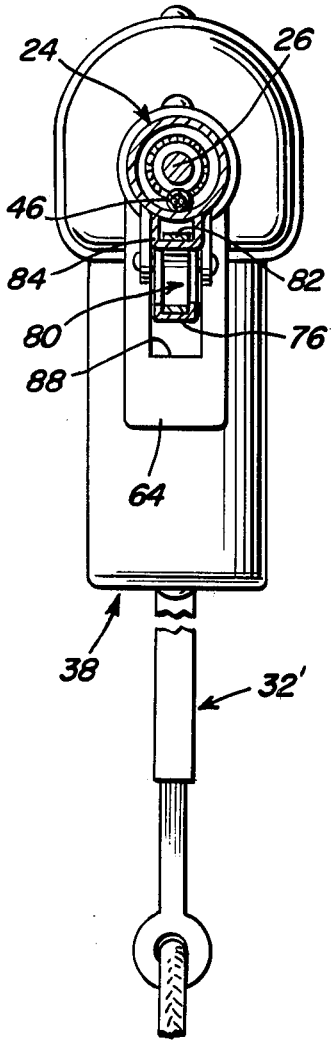
FIG. 5 is a fragmentary, sectional view taken generally along the line 5—5 of FIG. 4.
Figure 2:
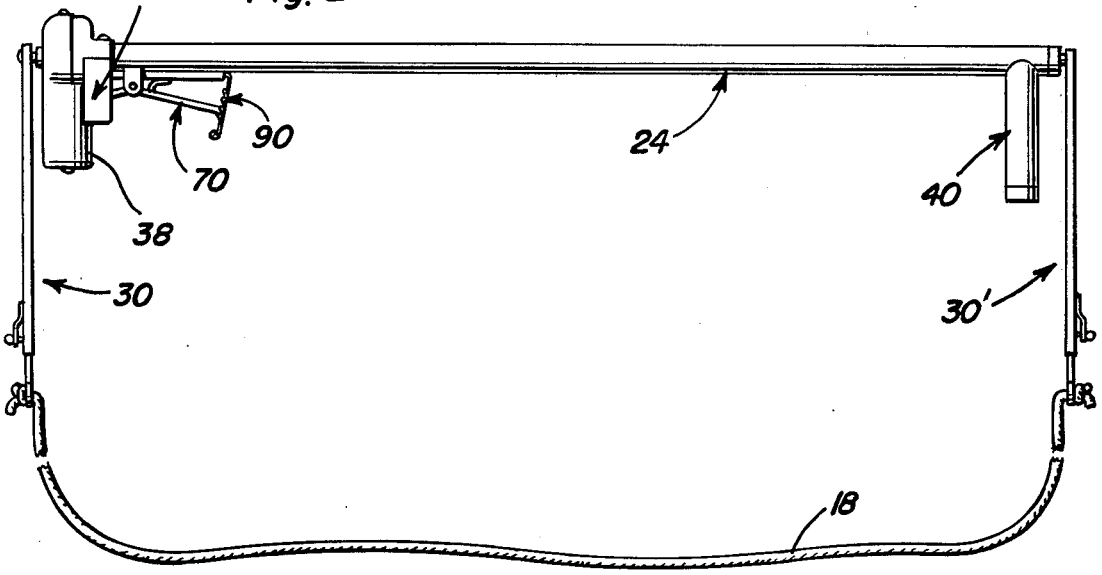
FIG. 2 is an enlarged, fragmentary, front elevational view showing the jump rope of FIG. 1.

Referring now more particularly to FIG. 1 of the drawings, an electric motor-driven jump rope 10 according to the present invention comprises a longitudinally extending member 12 having longitudinally spaced ends 14 and 16. A flexible element 18, which can be a length of conventional clothesline rope, and the like, has end portions 20 and 20' attached to respective ones of ends 14 and 16 so as to form a skipping rope. Mounted on member 12 is a motor assembly 22 connected to flexible element 18 for rotating same relative to the axis formed by the longitudinal extent of member 12.

Referring now more particularly to FIGS. 2 through 5 of the drawings, member 12 includes a tubular housing 24 through which extends an elongated rod 26 journaled adjacent the ends 14 and 16 of member 12 as by suitable bearings 28 and 28'. Flexible element 18 is connected directly to the ends of rod 26, which ends are outside of housing 24, as by length adjustable fittings 30 and 30' for adjustably connecting flexible element 18 to rod 26. Each of the fittings 30 and 30' includes a sleeve 32, 32' having telescoping links 34, 34', each provided with a plurality of apertures. The links 34, 34', which are selectively and adjustably secured to one another by respective detent lock assemblies 36 and 36' releasably engageable in the apertures provided in links 34, 34' to hold the links 34, 34' relative to the associated sleeves 32, 32', are connected to rod 26 in a suitable manner for rotation therewith, while each of the links 34 and 34' is provided with an eye for receiving an end portion 20, 20' of element 18. Appropriate knots are provided at end portions 20, 20' for retaining element 18 within the eyes of links 34, 34', the position of which knot can be changed to vary the length of flexible element 18 between the fittings 30, 30' and provide an additional length adjustment for flexible element 18 in addition to that provided by the fittings 30, 30' by relative thread-engaging movement of the links 34, 34' and 36, 36' with respect to the associated sleeve 32, 32'.

The member 12 further includes branch housing portions 38 and 40 attached to tubular housing 24 at respective ends 14 and 16 of member 12, and disposed extending perpendicularly to the longitudinal extent of both housing 24 and rod 26 for enclosing motor assembly 22. More specifically, motor assembly 22 includes a motor 42 disposed within portion 38, and electrical batteries 44 disposed in portion 40. A conventional electrical cable 46 extends along the length of housing 24, passes through an aperture 48 and terminates within portion 38 of member 12, for electrically connecting motor 42 to batteries 44.

A suitable contact assembly 50 of conventional construction is provided within housing portion 40 for removably placing the adjacent end of cable 46 in electrical contact with the uppermost of the batteries 44, while a conventional spiral spring contact 52 retained on portion 40 as by the illustrated screw cap 54 provides electrical contact to the bottom surface of the lowermost of the batteries 44. One wire W of cable 46 extends downwardly to housing portion 40 for electrical connection to the spring contact 52 in order to complete a circuit through the power supply formed by the batteries 44.

Motor 42 is provided with an output shaft 56 having splined thereon a, for example, roller 58 which engages by friction with a wheel 60 locked on rod 26 as by the illustrated key 62 disposed in suitably provided keyways. By this arrangement, rotation of shaft 56 by motor 42 will cause rotation of rod 26 within its associated bearings 28, 28'. Roller 58 and wheel 60 preferably have resilient surfaces constructed in a manner known per se, and allows for slippage in the event the rope becomes entangled.

Motor 42 is a variable speed motor of conventional construction, with the motor assembly 22 further including a variable speed switch 64 inserted into cable 46 for controlling the speed of motor 42. While any suitable speed control device may be used as switch 64, it is contemplated that the control include a rheostat 66 provided with a plurality of contacts 68. The latter can be, for example, magnetically actuated contacts as are conventional and well-known. Since it is contemplated that the construction of rheostat 66 is of a conventional nature and commercially available, it will not be described in greater detail herein.

A lever 70 is pivotally mounted on housing 24 for pivotal movement about a pin 72 journaled on suitable ears. Lever 70 has a pair of diverging arms 74 and 76, with arm 74 terminating in a magnet 78 arrangeable for selectively opening and closing the contact 68 of rheostat 66. Arm 76 is arranged for being engaged by a hand H of a person P (FIG. 1) in order to permit pivoting of lever 70 in such a manner that arm 76 is moved toward the housing 24 and the resistance of rheostat 66 decrease for increasing the speed of motor 42.

Figure 4:
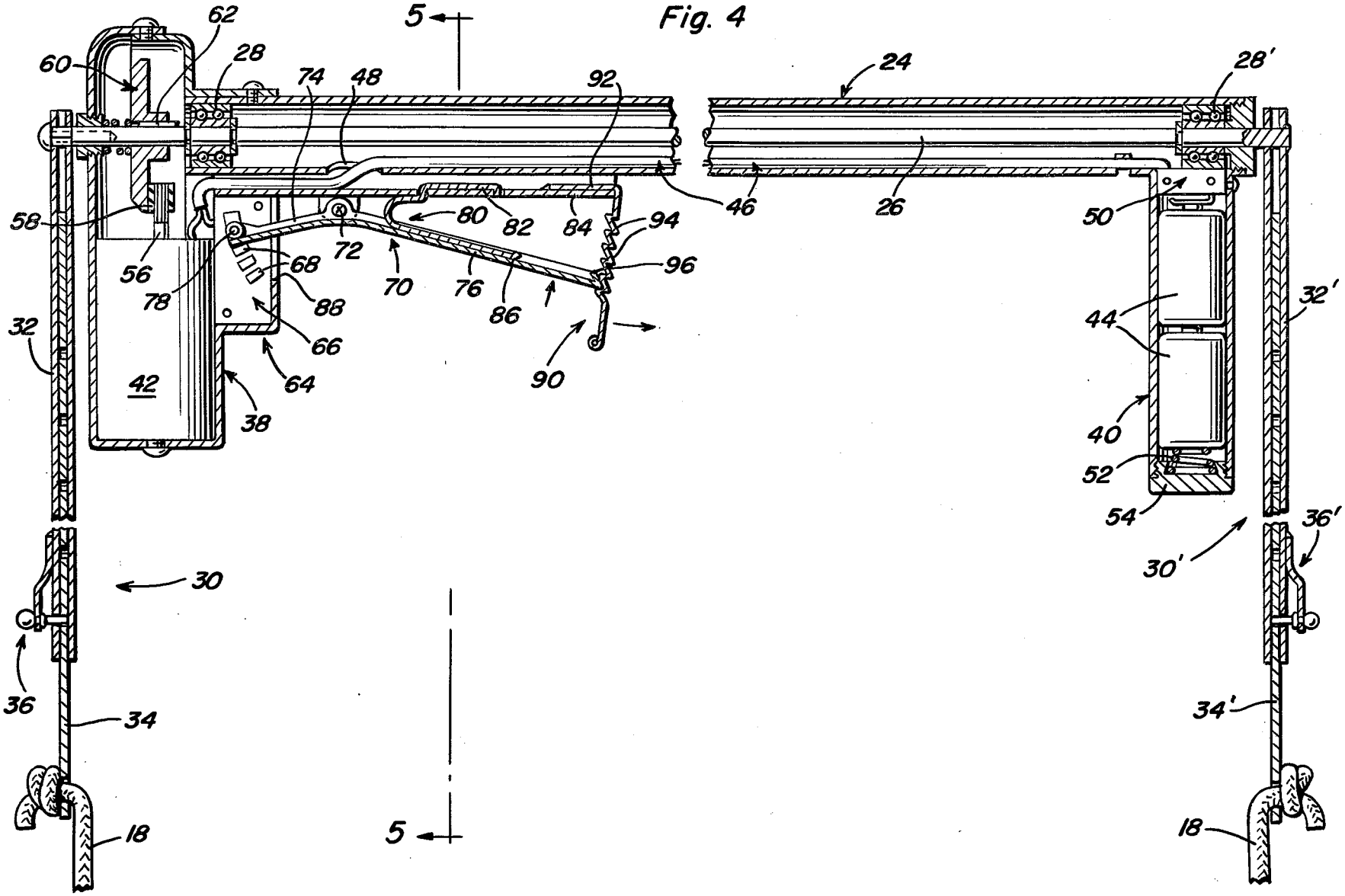
FIG. 4 is a fragmentary, sectional view taken generally along the line 4—4 of FIG. 3.

A leaf spring 80 is mounted on housing 24, with a leg 82 of spring 80 being disposed partially within a shroud 84 extending beneath housing 24 by use of apertures as soon in FIG. 4 for anchoring spring 80 to member 12. The other leg 86 of spring 80 is engaged with arm 76 of lever 70 for biasing arm 76 away from the shroud 84, or housing 24. Pin 72 which pivotally mounts lever 70 is itself mounted directly on the shroud 84 for indirect attachment to housing 24, while the arms 74 of lever 70 extends to rheostat 66 through a cutout 88 provided in a side wall of housing portion 38.

A ratchet 90 is mounted on shroud 84 and arranged engaging the outer tip of the other of the arms 76 of lever 70 for holding lever 70 in any one of a plurality of positions against the bias of spring 80. More specifically, ratchet 90, which is retained on shroud 24 as by the illustrated flange 92 and welding, bonding, and the like, is provided with a plurality of teeth 94 for selectively engaging a lip 96 terminating arm 76 of lever 70, which teeth 94 are arranged for corresponding to the spacing between the contacts 68 of rheostat 66. By this arrangement, the speed of motor 42 can be varied in predetermined increments.

In operation, and referring particularly to FIG. 1, a person P desiring to exercise with a jump rope 10 grasps the housing 24 with hands H, H', with the hands preferably spaced so as to be adjacent the ends 14 and 16 of member 12. Hand H can now start motor 42 in operation so as to rotate rod 26 and flexible element 18 for rope skipping in the conventional manner, with element 18 having been first adjusted to the proper size for person P. The speed of rotation of flexible element 18 can be increased by hand H pressing lever 70 toward housing 24, with ratchet 90 retaining lever 70 in a given position against the bias of spring 80 (FIG. 4). When person P desires to cease rope skipping, the motor assembly 22 can be deactivated by engaging the ratchet 90, which is resilient, with hand H and pulling it inward with the hand H'. If one wishes to jump backwards, jump rope 10 is merely turned around from the position seen in FIG. 1.

While a drive assembly including the crown gear 60 has been illustrated, it is to be understood that such drive assembly may be altered, if desired, and can take the form of a, for example, chain or belt drive (not shown). The over-all length of member 12 can be about, for example, 30 inches (76.2 cm).

As can be readily understood from the above description and from the drawings, a motor-driven jump rope according to the present invention provides a simple, yet rugged and reliable, device for exercising. Further, the jump rope according to the invention is completely portable, and a battery charger (not shown) of conventional construction can be provided for recharging the batteries of the device when same is not in use.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A jump rope comprising, in combination:

(a) a longitudinally extending member having longitudinally spaced ends, and comprising: a tubular housing; an elongated rod journalled within the housing and extending therefrom at the longitudinally spaced ends of the member, the tubular housing and rod extending longitudinally of the extent of the member;

(b) a flexible element having end portions attached directly to the rod at points thereon outside of the tubular housing;

(c) motor means including a variable speed electric motor mounted at one of the ends of the elongated member, batteries for energizing the motor being mountable at the other of the ends of the member, and a cable electrically connecting the motor to the batteries, the cable extending along the longitudinal extent of the member;

(d) a variable speed switch inserted in the cable for controlling the speed of the motor, said switch including: rheostat provided with a plurality of contacts; and a lever pivotally mounted on the member and having a pair of diverging arms, one of the arms engaging the rheostat for varying the resistance of the rheostat, and the other of the arms being engageable by a hand of a person grasping the member for pivoting the member and moving the other of the arms toward the member and decreasing the resistance of the rheostat;

(e) a spring mounted on the member and engaging the other of the arms of the lever for biasing the other of the arms away from the member;

(f) a ratchet mounted on the member and arranged engaging the other of the arms of the lever for holding in any one of a plurality of positions against the bias of the spring and varying the speed of the motor in predetermined increments; and (g) wherein the member further includes branch housing portions provided at either longitudinal end of the member and disposed extending perpendicularly to the tubular housing and rod and attached to the tubular housing for enclosing the motor and batteries, respectively, the one of the branch housing portions enclosing the motor also enclosing the rheostat and being disposed immediately adjacent the pivotally mounted lever of the speed control switch.

2. A jump rope, comprising, in combination:

(a) a longitudinally extending member having longitudinally spaced ends, and comprising: a tubular housing; an elongated rod journalled within the housing and extending therefrom at the longitudinally spaced ends of the member, the tubular housing and rod extending longitudinally of the extent of the member;

(b) a flexible element having end portions attached directly to the rod at points thereon outside of the tubular housing;

(c) motor means including a variable speed electric motor mounted at one of the ends of the elongated member, batteries for energizing the motor being mountable at the other of the ends of the members, and a cable electrically connecting the motor to the batteries, the cable extending along the longitudinal extent of the member;

(d) a variable speed switch inserted in the cable for controlling the speed of the motor, said switch including: rheostat provided with a plurality of contacts; and a lever pivotally mounted on the member and having a pair of diverging arms, one of the arms engaging the rheostat for varying the resistance of the rheostat, and the other of the arms being engageable by the hand of a person grasping the member for pivoting the member and moving the other of the arms toward the member and decreasing the resistance of the rheostat:

(e) a spring mounted on the member and engaging the other of the arms of the lever for biasing the other of the arms away from the member;

(f) a ratchet mounted on the member and arranged engaging the other of the arms of the lever for holding the lever in any one of a plurality of positions against the bias of the spring and varying the speed of the motor in predetermined increments; and (g) wherein the flexible element includes adjustable fittings provided at the end portions of the flexible element for adjustably connecting the flexible element to the rod, and further wherein the member further includes branch housing portions provided at either longitudinal end of the member and disposed extending perpendicularly to the tubular housing and rod and attached to the tubular housing for enclosing the motor and batteries, respectively, the one of the branch housing portions enclosing the motor also enclosing the rheostat and being disposed immediately adjacent the pivotally mounted lever of the speed control switch.

* * * * *